United States Patent [19]

Wise

[11] 3,953,017

[45] Apr. 27, 1976

[54] GATHERER SYSTEM

[75] Inventor: James C. Wise, Easton, Pa.

[73] Assignee: Harris-Intertype Corporation, Cleveland, Ohio

[22] Filed: May 7, 1973

[21] Appl. No.: 357,607

[52] U.S. Cl. ..... 270/54; 270/58

[51] Int. Cl.[2] ..... B65H 39/02

[58] Field of Search ..... 270/52, 53, 54, 55, 270/56, 57, 58; 271/57; 53/53, 54

[56] References Cited

UNITED STATES PATENTS

| | | | |
|---|---|---|---|
| 3,269,720 | 8/1966 | Schluckebier et al. | 270/57 |
| 3,484,100 | 12/1969 | Sather et al. | 270/58 |
| 3,525,516 | 8/1970 | Bushnell et al. | 270/54 X |
| 3,608,888 | 9/1971 | McCain et al. | 270/54 |
| 3,819,173 | 6/1974 | Anderson et al. | 270/58 |
| 3,825,246 | 7/1974 | Elia | 270/54 |
| 3,899,165 | 8/1975 | Abram et al. | 270/58 X |

OTHER PUBLICATIONS

Cosden, Thomas B.; "Split-Run"; *Book Production Industry*; Mar. 1970; pp. 34–37.

*Primary Examiner*—Richard C. Pinkham
*Assistant Examiner*—Vance Y. Hum

[57] ABSTRACT

An improved system for producing different magazines composed of different predetermined combinations of signatures for different subscribers in accordance with predetermined criteria from known subscriber information includes a main gatherer for forming main combinations of signatures. A secondary gatherer provides special combinations of signatures in accordance with the known subscriber criteria. Each special combination of signatures is combined with a main combination of signatures to form a complete magazine. In one form of the invention, if for some reason the secondary gatherer should malfunction, a resulting imperfect special combination of signatures is rejected. A supplemental feed is then activated to replace the rejected special combination of signatures with a standard combination of signatures which is combined with a main combination of signatures to form a magazine.

11 Claims, 5 Drawing Figures

GATHERER SYSTEM

BACKGROUND OF THE INVENTION

A known sheet material gathering system is utilized to produce different magazines composed of different predetermined combinations of signatures for different groups of subscribers classified in accordance with predetermined criteria, such as age, income, occupation, geographic location, etc. This known gatherer system includes a plurality of hoppers or pockets which are located at feed stations and contain different signatures. A control apparatus provides for the feeding of signatures from at least some of the pockets onto a conveyer to make up magazines which are labeled with the name and address of the subscriber to which they are to be sent. The control apparatus effects operation of the various signature feed mechanisms to feed a combination of signatures which is appropriate for the subscriber who is to receive a magazine. One known system for producing different magazines in this manner is disclosed in U.S. Pat. application Ser. No. 141,331, filed May 7, 1971, by Donald C. Harder and Victoriano F. Rana and entitled "Method and Apparatus for Producing Magazines or the Like."

Since the different magazines have different signatures depending upon the subscriber to whom the magazine is to be sent, some of the signature feed mechanisms must be intermittently operated. Thus if magazines which are to be sent to subscribers in a northern geographic area have a special combination of signatures, certain feed mechanisms are operated to feed signatures for magazines which are to be sent to the northern subscribers. The sheet feed mechanisms which feed special signatures for magazines to be sent to northern subscribers are rendered ineffective when feeding signatures to form magazines which are to be sent to southern subscribers. Since the sheet feed mechanisms which form special combinations of signatures are operated intermittently, the probability of a malfunction is far greater than if the sheet feed mechanisms were operated continuously.

Assuming that there is a malfunction in the sheet feed mechanism so that a signature fails to feed or is incorrectly fed, a whole group of signatures must be discarded. Even if the controls for the gatherer are constructed so that the sheet feed mechanisms downstream from a malfunction are rendered ineffective to reduce scrap material, the total productivity of the gatherer is decreased since the imperfect group of signatures will pas through the machine and the downstream sheet feed mechanisms will be inactive.

SUMMARY OF THE PRESENT INVENTION

The present invention increases the operating efficiency of a gatherer system which is utilized to produce magazines composed of different predetermined combinations of signatures for different subscribers by providing two gatherers. A relatively large main gatherer may be utilized to associate signatures which are sent to all of the subscribers while a relatively small or secondary gatherer may be, and probably is, utilized to form special combinations of signatures which may contain one or more sheets in accordance with the characteristics of the different subscribers. Each special combination of signatures for a particular subscriber is associated with a main group of signatures which are sent to all of the subscribers at one feed station of the main gatherer.

If for some reason the secondary gatherer should malfunction and form an imperfect special combination of signatures, this imperfect special combination of signatures is rejected. To promote efficient operation of the main gatherer and to reduce scrap, a standard group of signatures suitable for all subscribers is substituted for the rejected imperfect special combination of signatures. The standard combination of signatures is combined with a main group of signatures at a feed station of the main gatherer.

By utilizing the secondary gatherer to feed the special combinations of difficult-to-feed signatures, malfunctioning of the feed mechanisms in the main gatherer can be reduced since these feed mechanisms will be operated on a substantially continuous basis to feed signatures to each group of signatures. Since all or most of the special signatures which are only sent to certain subscribers are combined by the secondary conveyer, the intermittently operated feed mechanisms for these signatures are isolated from the main gatherer. In the event of a malfunctioning of these intermittently operated feed mechanisms, the error can be corrected without impairing the operating characteristics of the relatively large main gatherer.

Accordingly, it is the object of this invention to provide a new and improved system for producing different magazines composed of different predetermined combinations of signatures for different subscribers in accordance with predetermined criteria from known subscriber information and wherein the apparatus includes a main gatherer for forming a main combination of signatures, a secondary gatherer for feeding special combinations of signatures which may include one or more sheets in accordance with known subscriber criteria, and a mechanism for combining the special combinations of signatures formed by the secondary gatherer with the main combinations of signatures formed by the main gatherer.

Another object of this invention is to provide a new and improved system as set forth in the next preceding object and wherein an apparatus is provided for rejecting an imperfect special combination of signatures formed by the secondary gatherer and a feed mechanism is provided for substituting a standard combination of signatures suitable for any one of the different subscribers in place of the rejected imperfect special combination of signatures.

BRIEF DESCRIPTION OF THE DRAWINGS

The foregoing and other objects and features of the invention will become more apparent upon a consideration of the following description taken in connection with the accompanying drawings wherein.

DESCRIPTION OF SPECIFIC PREFERRED EMBODIMENTS

Figure 1:
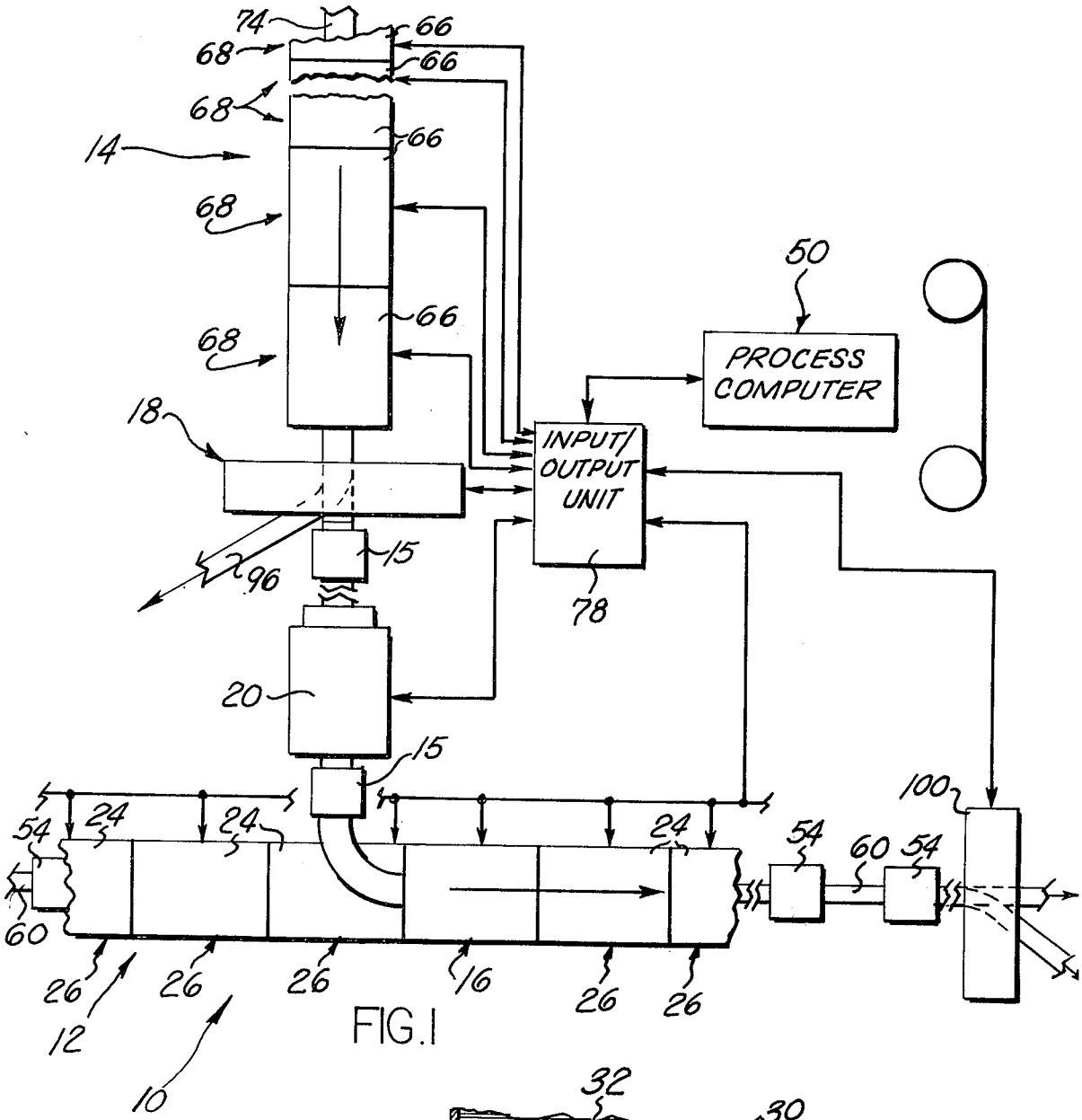
FIG. 1 is a schematic illustration of a gatherer system constructed in accordance with the present invention and includes a main gatherer assembly for forming a main combination of signatures and a secondary gatherer assembly feeding special combinations of signatures which are combined with the main combination of signatures.

A gatherer system 10 constructed in accordance with the present invention is illustrated schematically in FIG. 1 and is utilized to produce different magazines composed of different predetermined combinations of signatures for different subscribers in accordance with predetermined criteria from known subscriber information. The gatherer system 10 includes a main gatherer assembly 12 which forms a main combination of signatures. A secondary gatherer assembly 14 forms special combinations 15 of signatures, which may consist of one or more signatures, in accordance with known subscriber criteria and are associated with the main combinations of signatures at a delivery or feed station 16 of the main gatherer assembly 12. In the event of a malfunctioning of the secondary gatherer assembly 14, a reject mechanism 18 is operated to divert the imperfect special combination 15 of signatures and a supplemental feed mechanism 20 is operated to substitute a standard combination of one or more signatures suitable for all subscribers.

The main gatherer assembly 12 includes a plurality of signature feed mechanisms 24 which are disposed at feed stations 26. Each of the signature feed mechanisms 24 includes a supply hopper or pocket 30 (FIG. 2) which holds a plurality of signatures 32. The feed mechanism 24 includes a rotary drum 36 having grippers 38 and 40 to which sheets are fed by a sucker 42.

The drum 36 rotates in a counterclockwise direction (as viewed in FIG. 2) to move the grippers 38 and 40 sequentially past the bottom of the hopper 30. As an open gripper 38 or 40 is moved past the bottom of the hopper 30, the sucker 42 moves inward to deflect a forward corner of a lowermost signature downwardly. A cam 43 effects a closing of the gripper to firmly engage the signature and feed it from the hopper 30 during continued rotation of the drum 36. The construction of the rotary drum 36 and the interaction between the grippers 38 and 40, cam 43 and the sucker 42 may be generally of the type disclosed in U.S. Pat. No. 3,650,525.

To enable any malfunctioning of the feed mechanism 24 to be detected, a detector assembly 46 is provided in association with the rotary drum 36. The detector assembly 46 is of a known caliper construction and is effective to detect either a failure to feed a signature 32 from the supply hopper 30 or the feeding of more than one signature. In the event that more or less than one signature is fed, an output signal is provided over a lead 48 to a process computer 50 (FIG. 1). The interaction between the rotary drum 36 and the detector assembly 46 is the same as disclosed in U.S. Pat. Nos. 3,578,310 and 3,519,264.

After a signature 32 has been moved past the detector assembly 46, it is deposited on a group 54 of signatures carried by a main conveyer assembly 60. The main conveyer assembly 60 is of the flat back type which transports closed signatures in a pile with the folded backs of the signatures adjacent to the side of the conveyer assembly. The main conveyer assembly 60 carries a stream of groups 54 of signatures sequentially past each of the feed stations 26 of the main gatherer 12. Assuming that a signature is to be deposited on the group 54 of signatures at each of the feed stations 26, the process control computer 50 (FIG. 1) activates the feed mechanisms 24 to simultaneously feed signatures onto all of the groups 54 of signatures as they move past the feed stations 26 to form main combinations of signatures. Although only a few feed stations 26 and feed mechanisms 24 have been illustrated in FIG. 1, it should be understood that any desired number of feed stations and feed mechanisms could be provided in the main gatherer assembly 12.

In accordance with the present invention, the secondary gatherer assembly 14 is utilized to associate signatures into special combinations 15 or one or more signatures for different subscribers. It is contemplated that the subscribers will be broken down into groups and subgroups according to predetermined arbitrary criteria and that each group and subgroup will receive a different combination of signatures. Thus, the subscribers may be broken down into groups by geographic region. The secondary gatherer assembly 14 would then be utilized to form a special combination of one or more signatures which are of particular interest to a subscriber in a particular geographic region. Of course, the subscribers could be broken down by other criteria, such as age, income group, occupation, etc.

The special combinations 15 of signatures formed by the secondary gatherer assembly 14 are combined with the groups 54 of signatures carried by the main conveyer assembly 60 at the delivery or feed station 16 (see FIG. 1). Once the special combinations of signatures are disposed in a central portion of the magazines, the groups 54 of signatures and the special combination of signatures are transported by the main conveyer assembly 60 past downstream feed stations 26 until a complete magazine has been formed. Suitable addressing apparatus (not shown) is provided to address the magazines to the subscribers who are entitled to receive the special combinations of signatures formed by the secondary gatherer assembly 14 along with the signatures fed by the main gatherer assembly 12. This is accomplished under the direction of the process control computer 50 in the manner disclosed in U.S. Pat. application Ser. No. 141,331, filed May 7, 1971, by Donald C. Harder and Victoriano F. Rana and entitled "Method and Apparatus for Producing Magazines or the Like."

The secondary gatherer assembly 14 includes a plurality of feed mechanisms 66 disposed at feed stations 68. The feed mechanisms 66 are constructed in the same manner as are the feed mechanisms 24 and are effective to feed signatures onto a secondary conveyer assembly 74. The secondary conveyer assembly 74 is of the flat back type and transports a group of closed signatures in a pile with the backs of the signatures adjacent to one side of the conveyer assembly. The secondary conveyer assembly 60 transports the special combinations 15 of signatures to the feed mechanism 16 which combines them with a group 54 of signatures on the main conveyer assembly 60. It should be noted that the main conveyer assembly 60 is of a flat back type of a construction similar to that shown in U.S. Pat. No. 2,621,039, rather than the saddle back type of construction shown in U.S. Pat. No. 3,032,336. Since the main conveyer assembly 60 is of the flat back type, a plurality of closed signatures can be deposited at a time on the main conveyer assembly 60 at the delivery or feed station 16.

Since the feed mechanisms 66 in the secondary conveyer assembly 14 are utilized to form special combinations 15 of signatures, it is contemplated that these feed mechanisms will be operated intermittently since different signatures will be utilized in different special combinations of signatures. Thus if a feed mechanism 66 is utilized to feed signatures which are associated with one geographic area, the process computer 50 will render this feed mechanism ineffective when special combinations of signatures associated with other geographic areas are being formed. Of course, if the special combinations 15 of signatures are made upon a basis of geographic area and, for example, occupation, different feed mechanisms 66 would be activated for a given geographic area depending upon the occupation of the subscriber who is to receive the completed magazine.

Figure 2:
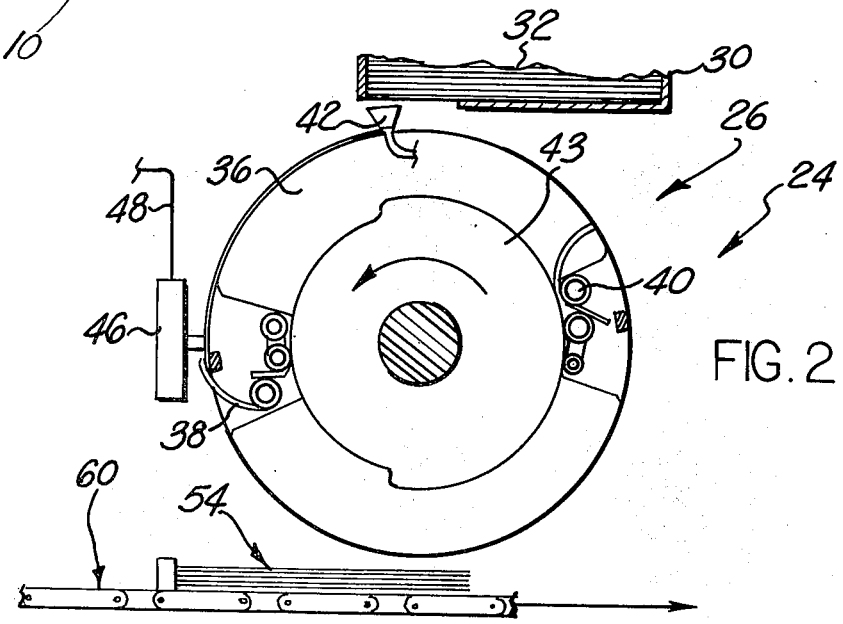
FIG. 2 is a schematic illustration of a mechanism for feeding signatures.

Malfunction detectors, similar to the detectors 46 of FIG. 2, are associated with each of the feed mechanisms 66. If a malfunctioning of one of the feed mechanisms 66 should occur, a signal is transmitted from the detector for this feed mechanism to an input-output unit 78 for the process computer 50. When the input-output unit 78 receives a signal indicating that a feed mechanism 66 has malfunctioned, a signal is transmitted to a pocket disable unit within the process computer 50. Thereupon, the process computer 50 preferably instructs all the feed mechanisms 66 downstream from the feed mechanism at which an error occurred, not to feed signatures to the combination of signatures in which the error occurred. This prevents good signatures from being fed onto an imperfect combination of signatures.

To enable the process computer 50 to effect intermittent operation of the feed mechanisms 66 to feed predetermined signatures to form a special group of signatures and to enable the process computer 50 to prevent the feeding of signatures by downstream feed mechanisms after the occurrence of a malfunction at one of the feed mechanisms, it is necessary for the process computer 50 to be able to selectively render any one of the feed mechanisms either effective or ineffective to feed signatures. To this end, solenoid operated valves 82 and 84 (FIG. 3) are associated with each of the suckers 42 in the feed mechanisms 66. When the solenoid 82 is in an open condition, the sucker 42 is connected with a source of low pressure or suction through a conduit 86. When the sucker 42 is connected with the source of low pressure, it is effective to feed a signature from an associated storage hopper.

Figure 3:
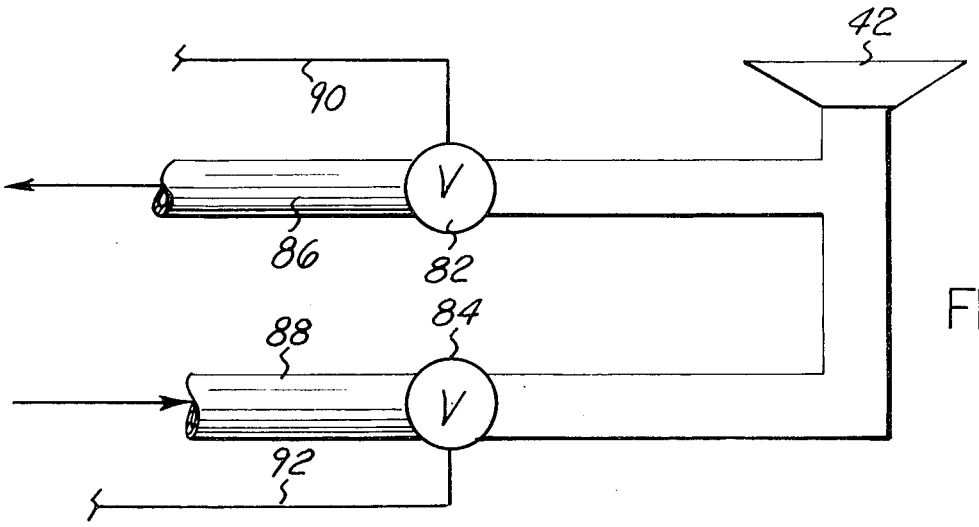
FIG. 3 is a schematic illustration of apparatus for controlling the operation of a sucker in the feed mechanism of FIG. 2.

When the feed mechanism 66 associated with the sucker 42 of FIG. 3 is to be rendered ineffective, the valve 82 is closed and the valve 84 is opened. Valve 84 is connected with a source of air under pressure through a conduit 88. When the valve 84 is opened and the valve 82 is closed, the air under pressure flows to the sucker 42 so that it is ineffective to grip a signature in a storage hopper. The solenoid operated valves 82 and 84 are selectively operated under the control of the process computer 50 which is connected with the valves by leads indicated at 90 and 92 in FIG. 3. The interaction between the sucker 42, detector 46 and control valves 82 and 84 for a feed mechanism 66 is similar to that disclosed in U.S. Pat. No. 3,519,264.

Upon the occurrence of the malfunctioning of one of the feed mechanisms 66 in the secondary gatherer 14, the process computer 50 sequentially renders the downstream feed mechanisms ineffective to feed signatures to the imperfect portion of a special combination of signatures. In addition, the reject mechanism 18 is rendered effective to divert the imperfect special combination of signatures onto a reject conveyer 96. This prevents the imperfect special combination signatures from being combined with the signatures 54 on the main conveyer assembly 60. Although the reject unit 18 could have many different types of construction, it is contemplated that it may include a divert unit similar to the one disclosed in U.S. Pat. application Ser. No. 176,851, filed Sept. 1, 1971, by Frederick D. Anderson and David A. Reed and entitled "Method and Apparatus for Producing Magazines or the Like."

Each time an imperfect special combination of signatures is rejected, there is a blank or interruption in the stream of special combinations of signatures transported to the feed mechanism 16 by the secondary conveyor assembly 14. However, the main conveyor assembly 60 is transporting a group 54 of signatures to the feed mechanism for association with the special combination of signatures which was rejected. To enable this group 54 of signatures to be utilized to form a magazine, the supplemental feed mechanism 20 is effective to deposit a standard combination of signatures on the secondary conveyor assembly 74 in place of the rejected or imperfect special combination of signatures. The standard combination of signatures can be sent to any subscriber in place of the special combination of signatures. Although the magazine containing the standard combination of signatures will not be directed to the specific characteristics of the subscriber which receives the magazine, it is contemplated that relatively small numbers of such magazines would be sent out and that in the interest of efficient operation of the gatherer system 10, this is acceptable.

Although the feed mechanism 20 for the standard combination of signatures could have made different constructions, it is contemplated that it will be constructed in a manner similar to that disclosed in U.S. Pat. No. 3,692,300. This feed mechanism includes a sucker, similar to the sucker 42 of FIG. 3. In the absence of a malfunctioning of one of the feed mechanisms 66, the sucker for the feed mechanism 20 will be connected in fluid communication with a source of air under pressure to thereby render the feed mechanism 20 ineffective to feed a standard combination of signatures.

In the event of a malfunctioning of one of the feed mechanisms 66, the reject mechanism 18 is operated to reject the resulting imperfect special combination of signatures. Thereafter, the sucker for the feed mechanism 20 is connected with a source of low pressure or suction to deposit a standard group of signatures on the secondary conveyer 74 in place of the rejected imperfect special combination of signatures. This enables the secondary conveyer assembly 74 to conduct an uninterrupted stream of special and standard combinations of signatures to the feed mechanism 16. Therefore, the secondary gatherer 14 and feed mechanism 20 are operated by the process computer 50 to supply either a special or standard combination of signatures for each group 54 of signatures transported by the main conveyer assembly 60.

Since the special combinations of signatures are fed at the intermittently operated feed mechanisms of the secondary conveyer assembly 14, it is contemplated that there will be relatively few malfunctions at the continuously-operated feed mechanisms 24 for the main conveyer assembly 12. However, in the event that the detector 46 for one of the feed mechanisms 24 detects a malfunction at a feed mechanism in the main conveyer 12, the process computer 50 renders the downstream mechanisms 24 ineffective to feed signatures for a cycle or cycles corresponding to passage of the resulting imperfect group or groups of signatures. However, the delivery or feed mechanism 16 will be effective to deposit a special combination of signatures on an imperfect group of signatures resulting from a malfunctioning of a feed mechanism 24 upstream from the delivery or feed mechanism 16. A reject mechanism 100 is activated by the process computer 50 to reject the imperfect combination of signatures. The process computer 50 recycles the information for the subscriber for whom the rejected imperfect combination of signatures was intended so that a second special combination of signatures will be prepared for this subscriber.

In the embodiment of the invention illustrated in FIG. 1 the feed mechanism 20 is effective to deposit a standard group of one or more signatures directly on the secondary conveyer assembly 74 in place of a rejected imperfect special combination of signatures. In the embodiment of the invention illustrated in FIG. 4, a supplemental feed mechanism 120 is effective to deposit a standard combination of one or more signatures directly onto the main conveyer assembly 60. Since the components of the embodiment of the invention illustrated in FIG. 4 are generally similar to the components of the embodiment of the invention illustrated in FIG. 1, the same numerals will be utilized to designate similar components, the suffix letter "*a*" being associated with the numerals of FIG. 4 to avoid confusion.

The gatherer system 10*a* includes a main gatherer 12*a* and a secondary gatherer 14*a*. Operation of the two gatherers 12*a* and 14*a* is controlled by a process computer 50*a*. A feed mechanism 16*a* sequentially feeds special combinations of one or more signatures formed by the secondary gatherer 14*a* onto a group of signatures on a main conveyer assembly 60*a*.

In the event of a malfunctioning of a feed mechanism 66*a* in the secondary gatherer 14*a*, a reject mechanism 18*a* is activated to reject an imperfect special combination of signatures onto a reject conveyer 96*a*. The resulting interruption in the stream of special combinations render the feed mechanism 16*a* ineffective to feed a special combination of signatures onto a group of signatures carried by the main conveyer assembly 60*a*. However, the process computer 50*a* will activate the feed mechanism 120 to feed a standard combination of signatures directly onto the main conveyer assembly 60*a* in place of the rejected special combination of signatures. It should be noted that the feed mechanism 120 is of the same construction as the feed mechanism 20 of FIG. 1.

Figure 4:
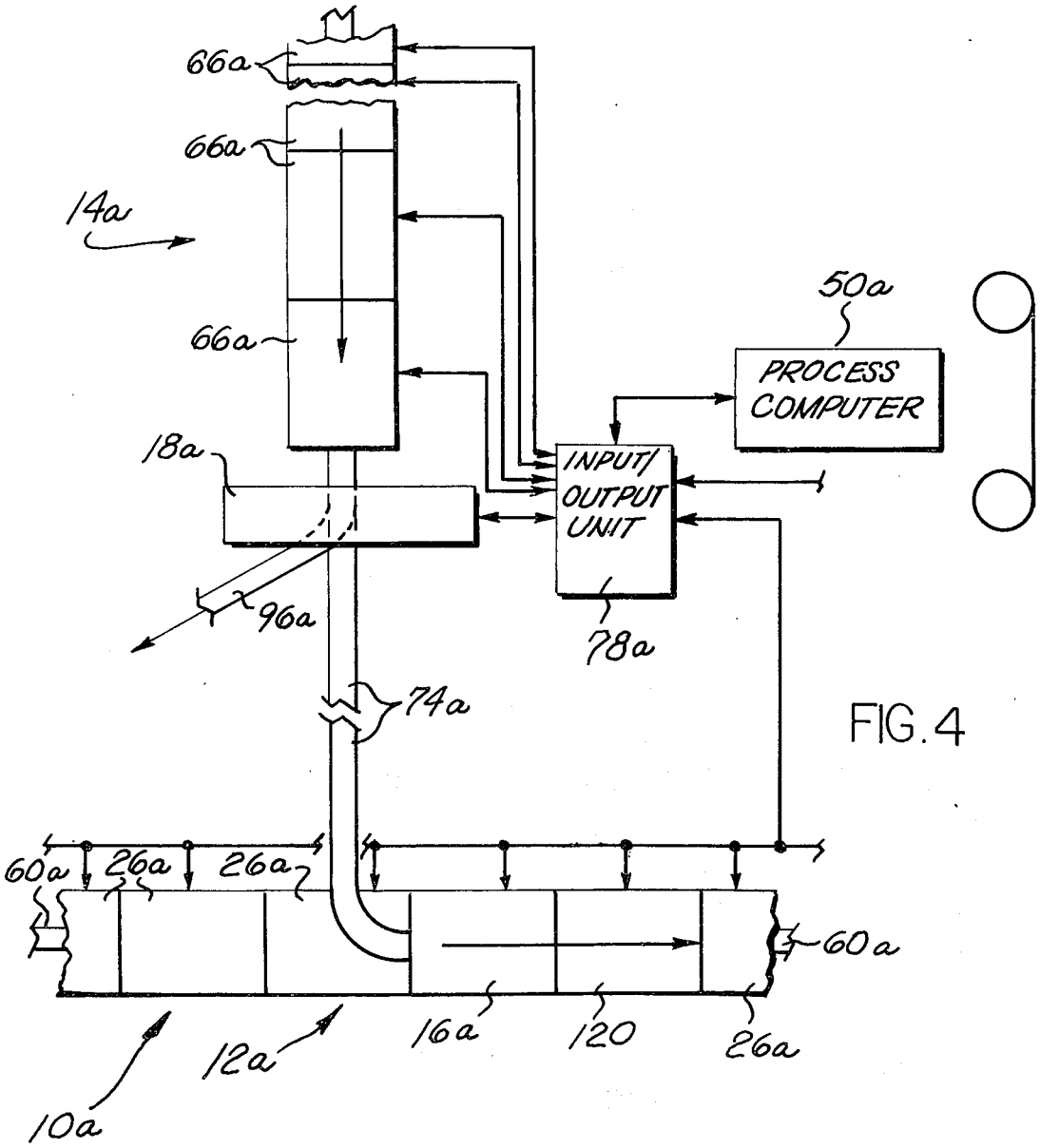
FIG. 4 is a schematic illustration of a second embodiment of the invention.
Figure 5:
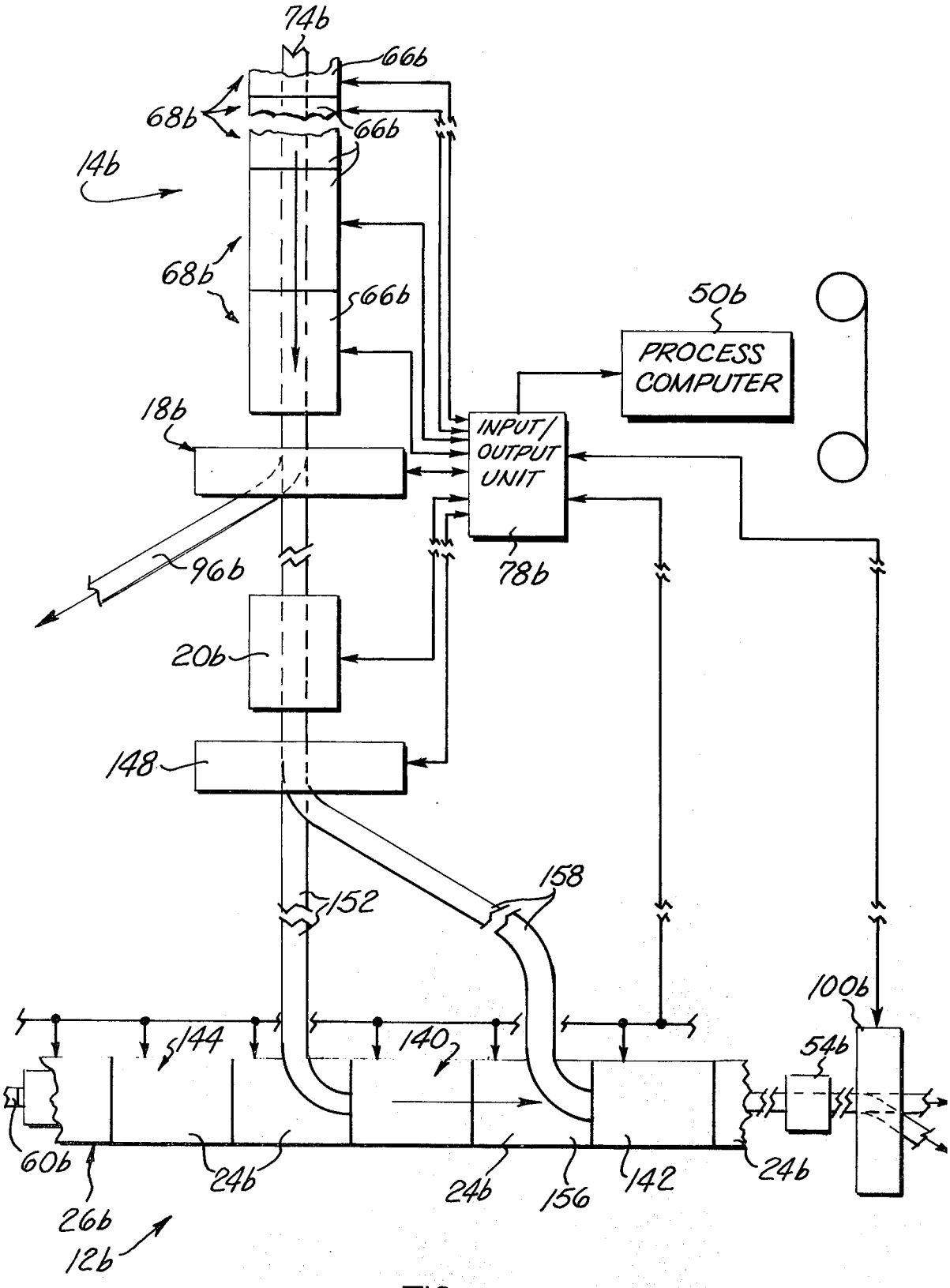
FIG. 5 is a schematic illustration of another embodiment of the invention.

In the embodiments of the invention illustrated in FIGS. 1 and 4, the secondary gatherers 14 and 14*a* are depicted as feeding the special combinations of one or more signatures to one station of the main gatherer 12 or 12*a*. It is contemplated that the feed station to which the secondary gatherer feeds the special combination of signatures may be varied along the length of the main gatherer 12 or 12*a* depending upon the desired position of the special combination of signatures in the completed magazine. In the embodiment of the invention illustrated in FIG. 5, a special combination of one or more signatures can be fed to either one of two stations on a main gatherer so that the special combination of signatures can be disposed at one location in a magazine for one group of subscribers and at another location in a magazine for another group of subscribers. Since the components of the embodiment of the invention illustrated in FIG. 5 are generally similar to the components of the embodiment of the invention illustrated in FIG. 1, the same numerals will be utilized to designate similar components, the suffix letter "*b*" being associated with the numerals of FIG. 5 to avoid confusion.

The gatherer system 10*b* includes a main gatherer 12*b* and a secondary gatherer 14*b*. Operation of the two gatherers 12*b* and 14*b* is controlled by a process control computer 50*b*. In the event of a malfunctioning of feed mechanisms 66*b* at feed stations 68*b* in the secondary gatherer 14*b*, a reject mechanism 18*b* diverts the imperfectly formed special combination of signatures onto a reject conveyer 96*b*. A supplemental feed mechanism 20*b* is then activated by the process computer 50*b* to feed a standard combination of signatures onto the secondary conveyer assembly 74*b*.

In accordance with the feature of the present invention, a special combination of signatures can be transported by the secondary conveyer assembly 74*b* to either one of two feed stations 140 or 142 in the main gatherer 12*b*. Thus, if a special combination of signatures is to be located in a magazine adjacent to signatures fed by main feed mechanism 24*b* at a feed station 144, a divert gate 148 is operated by the computer 50*b* to direct the special combination of signatures onto a first section 152 of the secondary conveyer assembly 74*b*. The first section 152 of the secondary conveyer assembly 74*b* would transport the special combination of signatures to the feed station 140.

It it was desired to place the special combination of signatures in a different location, for example immediately adjacent to signatures fed by a main feed mechanism 24*b* at a feed station 156, the divert gate 148 is operated by the process computer 50*b* to direct the special combination of signatures onto a second section 158 of the main conveyer assembly 74*b*. The section 158 of the main conveyer assembly 74*b* would transport the special combination of signatures to a second feed station 142. The feed stations 140 and 142 have suitable feed mechanisms, such as the one disclosed in U.S. Pat. No. 3,416,679, to feed the special combinations of signatures onto the main conveyer assembly 60*b*.

Although the secondary gatherers 14, 14*a*, and 14*b* have been described herein as being effective to form special combinations of signatures by depositing a plurality of signatures onto the secondary conveyer it is contemplated that only one of the secondary feed mechanisms need be operative to feed a group of signatures at one of the feed stations to provide the special combination of signatures. For example, a different special combination of signatures could be provided in each of the loading hoppers for the feed mechanisms 66*b* for subscribers having different ZIP codes. The feed mechanisms 66*b* would then be sequentially activated to feed one special combination of signatures at one feed station 68*b* for a subscriber having a particular ZIP code. This special combination of signatures would then be transported by the conveyer assembly 74*b* to one of the two feed stations 140 or 142.

In view of the foregoing description, it can be seen that the system 10 for producing different magazines composed of different predetermined combinations of signatures for different subscribers according to a predetermined criteria from known subscriber information includes a main gatherer 12 which forms a main combination or group 54 of signatures. A secondary gatherer 14 forms a special combination of signatures for each subscriber in accordance with the known information for that subscriber. This special combination of signatures is combined with the main combination of signatures by a feed mechanism 16. Since the special combinations of signatures is formed by the secondary gatherer 14, any malfunctioning of the intermittently operated feed mechanisms 66 in the secondary gatherer 14 are isolated from the relatively large main gatherer 12.

In the event of a malfunctioning of one of the feed mechanisms 66 in the secondary gatherer 14, a feed mechanism 20 is effective to substitute a standard combination of signatures suitable for any one of the different subscribers in place of the resulting imperfect special combination of signatures. The imperfect special combination of signatures is rejected by a rejector mechanism 18. In the embodiment of the illustration in FIG. 1, the feed mechanism 20 is effective to deposit the standard group of signatures directly onto the secondary conveyer assembly 74. However in the embodiment of the invention illustrated in FIG. 4, the feed mechanism 120 deposits a standard combination of signatures directly onto the main conveyer assembly 60*a*.

Although the gatherer system 10 has been described herein as being utilized to form magazines, it is contemplated that the gatherer system could be utilized to form many different types of sheet material articles, such as books, booklets, pamphlets, etc. Accordingly, the word magazines is utilized in the specification and claims to denote any of these known articles which are formed of sheets of material.

Having described specific preferred embodiments of the invention, the following is claimed:

1. A system for producing different magazines composed of different predetermined combinations of signatures for different subscribers in accordance with predetermined criteria from known subscriber information, said system comprising main gatherer means for feeding main combinations of signatures, said main gatherer means including a means for defining a plurality of main feed stations, main feed means at said main feed stations for feeding signatures, and main conveyer means for receiving signatures from said main feed means at said main feed stations and transporting the signatures to a receiving location, secondary gatherer means for feeding special combinations of signatures in accordance with known subscriber criteria, said secondary gatherer means including means for defining a plurality of secondary feed stations spaced from said main gatherer means, secondary conveyer means for transporting signatures, and a plurality of secondary feed means each of which is associated with one of said secondary feed stations for feeding signatures at said secondary feed stations to said secondary conveyer means, control means for rendering some of said secondary feed means ineffective to feed signatures to said secondary conveyer means and for effecting operation of at least one of the other of said secondary feed means to feed signatures to said secondary conveyer means to provide special combinations of signatures for different subscribers, rejector means for rejecting an imperfect special combination of signatures, supplemental feed means for feeding a standard combination of signatures suitable for any one of the different subscribers in place of a rejected special combination of signatures, and signature feed means for combining a special combination of signatures fed by said secondary gatherer means with a main combination of signatures fed by said main gatherer means, said control means including detector means for detecting a malfunctioning of one of said secondary feed means and the resulting formation of an imperfect special combination of signatures, and means for activating said rejector means in response to detection of a malfunctioning of one of said secondary feed means by said detector means to reject the resulting imperfect special combination of signatures and for activating said supplemental feed means to feed a standard combination of signatures in place of the rejected special combination of signatures.

2. A system as set forth in claim 1 wherein said supplemental feed means includes means for feeding a standard combination of signatures onto said secondary conveyer means.

3. A system as set forth in claim 1 wherein said supplemental feed means includes means for feeding a standard combination of signatures onto said main conveyer means in association with a main combination of signatures.

4. A system as set forth in claim 1 further including main rejector means for rejecting a combination of signatures from said main conveyer means, said control means further including supplemental detector means detecting malfunctioning of said supplemental feed means and means for activating said main rejector means in response to detection of a malfunctioning of said supplemental feed means.

5. A system as set forth in claim 1 wherein secondary conveyer means includes means for transporting special combinations of signatures to any one of a plurality of different locations relative to said main feed means to enable the special combinations of signatures to be combined in any one of a plurality of different relationships with the main combination of signatures.

6. A system as set forth in claim 1 wherein said main feed means includes a first signature feed mechanism disposed at a first main feed station for feeding a first signature onto said main conveyer means and a second signature feed mechanism disposed at a second main feed station for feeding a second signature onto said main conveyer means, said secondary conveyer means including means for sequentially transporting special combinations of signatures to one feed station where each special combination of signatures is deposited in turn onto one of first signatures by said signature feed means and for sequentially transporting special combinations of signatures to another feed station where each special combination of signatures is deposited in turn onto one of said second signatures by said signature feed means.

7. A system for producing different magazines composed of at least two combinations of signatures, said system comprising main gatherer means for forming first combinations of signatures, said main gatherer means including a means for defining a plurality of main feed stations, main feed means at said main feed stations for feeding signatures, and main conveyer means for receiving signatures from said main feed means at said main feed stations and transporting the signatures to a receiving location, secondary gatherer means for feeding second combinations of signatures, said secondary gatherer means including means for defining a plurality of secondary feed stations spaced from said main gatherer means, secondary conveyer means for transporting groups of signatures, and a plurality of secondary feed means each of which is associated with one of said secondary feed stations for feeding signatures at said secondary feed stations to said secondary conveyer means, rejector means for rejecting an imperfect second combination of signatures, supplemental feed means for feeding a third combination of signatures in place of a rejected second combination of signatures, control means for controlling the operation of said main gatherer means, secondary gatherer means, rejector means and supplemental feed means, said control means including means for rendering some of said secondary feed means ineffective to feed signatures to said secondary conveyer means and for effecting operation of other of said secondary feed means to feed signatures to said conveyer means, detector means for detecting a malfunctioning of one of said secondary feed means and the resulting imperfect feeding of a second combination of signatures, and means for activating said rejector means in response to detection of a malfunctioning of one of said secondary feed means by said detector means to reject the resulting imperfect second combination of signatures and for activating said supplemental feed means to feed a third combination of signatures in place of the rejected second combination of signatures, and means for combining either a second or a third combination of signatures with a first combination of signatures.

8. A system for producing different magazines composed of different predetermined combinations of signatures for different subscribers in accordance with predetermined criteria from known subscriber information, said system comprising main gatherer means for feeding main combinations of signatures, said main gatherer means including a means for defining a plurality of main feed stations, main feed means at said main feed stations for feeding signatures, and main conveyer means for receiving signatures from said main feed means at said main feed stations and transporting the signatures to a receiving location, secondary gatherer means for feeding at least two different special combinations of signatures in accordance with known subscriber criteria, said secondary gatherer means including means for defining a plurality of secondary feed stations spaced from said main gatherer means, secondary conveyer means for transporting signatures, and a plurality of secondary feed means each of which is associated with one of said secondary feed stations for feeding signatures at said secondary feed stations to said secondary conveyer means, control means for rendering some of said secondary feed means ineffective to feed signatures to said secondary conveyer means and effecting operation of at least one of the other of said secondary feed means to feed signatures to said secondary conveyer means to provide a first special combination of signatures for one subscriber and for thereafter rendering at least said one of said secondary feed means ineffective to feed signatures to said secondary conveyer means and effecting operation of at least some of said secondary feed means to feed signatures to said secondary conveyer means to provide a second special combination of signatures which is different than said first special combination of signatures, and signature feed means for combining a special combination of signatures fed by said secondary gatherer means with a main combination of signatures fed by said main gatherer means.

9. A system for producing different magazines composed of different combinations of signatures for different subscribers, said system comprising main gatherer means for forming main combinations of signatures, said main gatherer means including a means for defining a plurality of main feed stations, main feed means at said main feed stations for feeding signatures, and main conveyer means for receiving signatures from said main feed means at said main feed stations and transporting the signatures to a receiving location, secondary feed means for feeding special combinations of signatures for predetermined subscribers, detector means for detecting a malfunctioning of said secondary feed means and the resulting imperfect feeding of a special combination of signatures, supplemental feed means for feeding a standard combination of signatures which is different from the special combination of signatures and is suitable for anyone of the subscribers in place of a special combination of signatures, control means for activating said supplemental feed means to feed a standard combination of signatures in place of an imperfect special combination of signatures, and means for combining either a special or a standard combination of signatures with a main combination of signatures.

10. A system for producing different magazines composed of different combinations of signatures for different subscribers, said system comprising main gatherer means for forming main combinations of signatures, said main gatherer means including a means for defining a plurality of main feed stations, main feed means at said main feed stations for feeding signatures, and main conveyer means for receiving signatures from said main feed means at said main feed stations and transporting the signatures to a receiving location, secondary gatherer means for forming special combinations of signatures for different subscribers, said secondary gatherer means including means for defining a plurality of secondary feed stations spaced from said main gatherer means, secondary conveyer means for transporting groups of signatures, and a plurality of secondary feed means each of which is associated with one of said secondary feed stations for feeding signatures at said secondary feed stations to said secondary conveyer means, means for rendering different ones of said secondary feed means effective to feed signatures to said secondary conveyer means to form different special combinations of signatures for different subscribers, detector means for detecting a malfunctioning of one of said secondary feed means and the resulting imperfect forming of a special combination of signatures by said secondary feed means, rejector means for rejecting an imperfect special combination of signatures, supplemental feed means for feeding a standard combination of signatures suitable for any one of the subscribers in place of a rejected special combination of signatures, means for activating said rejector means in response to detection of a malfunctioning of one of said secondary feed means by said detector means to reject the resulting imperfect special combination of signatures and for activating said supplemental feed means to feed a standard combination of signatures in place of the rejected special combination of signatures, and means for combining either a special or a standard combination of signatures with a main combination of signatures.

11. A system for producing different magazines composed of different combinations of signatures for different subscribers, said system comprising main gatherer means for forming main combinations of signatures, said main gatherer means including a means for defining a plurality of main feed stations, main feed means at said main feed stations for feeding signatures, and main conveyer means for receiving signatures from said main feed means at said main feed stations and transporting the signatures along a main path to a receiving location, secondary gatherer means for forming special combinations of signatures for different subscribers, said secondary gatherer means including means for defining a plurality of secondary feed stations spaced from said main gatherer means, secondary conveyer means for transporting groups of signatures along a secondary path spaced apart from the main path and at least a portion of which extends transversely to said main path, and a plurality of secondary feed means each of which is associated with one of said secondary feed stations for feeding signatures at said secondary feed stations to said secondary conveyer means, means for rendering different ones of said secondary feed means effective to feed signatures to said secondary conveyer means to form different special combinations of signatures for different subscribers, detector means for detecting a malfunctioning of one of said secondary feed means and the resulting imperfect forming of a special combination of signatures by said secondary feed means, rejector means for rejecting an imperfect special combination of signatures, supplemental feed means for feeding a standard combination of signatures suitable for any one of the subscribers in place of a rejected special combination of signatures, means for activating said rejector means in response to detection of a malfunctioning of one of said secondary feed means by said detector means to reject the resulting imperfect special combination of signatures and for activating said supplemental feed means to feed a standard combination of signatures in place of the rejected special combination of signatures, and means at one of said feed stations of said main conveyer means for combining either a special combination of signatures formed by said secondary gatherer means or a standard combination of signatures fed by said supplemental feed means with a main combination of signatures being transported along the main path by said main conveyor means.

* * * * *

UNITED STATES PATENT OFFICE

CERTIFICATE OF CORRECTION

Patent No. 3,953,017 Dated April 27, 1976

Inventor(s) James C. Wise

It is certified that error appears in the above-identified patent and that said Letters Patent are hereby corrected as shown below:

In claim 7, line 30, after "to said" and before "conveyer" add --secondary--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*